US011723445B2

(12) United States Patent
Siegenthaler

(10) Patent No.: US 11,723,445 B2
(45) Date of Patent: Aug. 15, 2023

(54) LOCKING SYSTEM FOR THE ROTATING FOOT OF A MAST, PARTICULARLY FOR A FREE ARM STANDING PARASOL

(71) Applicant: Glatz AG, Frauenfeld (CH)

(72) Inventor: Robert Ulrich Siegenthaler, Bulach (CH)

(73) Assignee: Glatz AG

( * ) Notice: Subject to any disclaimer, the term of this patent is extended or adjusted under 35 U.S.C. 154(b) by 0 days.

(21) Appl. No.: 17/244,266

(22) Filed: Apr. 29, 2021

(65) Prior Publication Data

US 2021/0337944 A1 Nov. 4, 2021

(30) Foreign Application Priority Data

Apr. 30, 2020 (DE) ..... 202020102422.1

(51) Int. Cl.
*A45B 23/00* (2006.01)

(52) U.S. Cl.
CPC ..... *A45B 23/00* (2013.01); *A45B 2023/0043* (2013.01); *A45B 2023/0075* (2013.01)

(58) Field of Classification Search
CPC ..... A45B 2023/0075; E04H 12/2238; E04H 12/2284
See application file for complete search history.

(56) References Cited

U.S. PATENT DOCUMENTS 5,499,644 A 3/1996 Geniele
6,511,033 B2 * 1/2003 Li ..... A45B 23/00 248/519
8,807,513 B2 8/2014 Volin
2001/0040208 A1 11/2001 Li
2002/0185582 A1 * 12/2002 Li ..... E04H 12/2238 248/522

(Continued)

FOREIGN PATENT DOCUMENTS

CN 202955435 U 5/2013
CN 205658488 U 10/2016

(Continued)

OTHER PUBLICATIONS

Search Report from parent German parent App. No DE202020102422.1 and machine translation thereof.

*Primary Examiner* — Noah Chandler Hawk
(74) *Attorney, Agent, or Firm* — George Pappas; Barrett McNagny LLP

(57) ABSTRACT

In a locking system for a rotating foot of a mast, particularly of a mast for a free arm standing parasol, the mast is rotatable about an axis of rotation (A) defined by the rotating foot and includes a surrounded mast region. The locking system includes an operating lever for releasing or locking of the rotating foot which is arranged on the mast at a comfort height (H) of 0.5 to 1.5 m above the rotating foot, wherein the operating lever is movable between a folded-out position and a downwardly folded-in position and thereby cooperates via a lifting bar with stationary engaging elements of the rotating foot, wherein the lifting bar is raised in the release position and lowered in the locking position. To improve operability and operational security, the lifting bar is arranged at a distance from the axis of rotation (A) and externally of the surrounded mast region.

11 Claims, 4 Drawing Sheets

(56) References Cited

U.S. PATENT DOCUMENTS

| | | | | |
|---|---|---|---|---|
| 2013/0306828 | A1* | 11/2013 | Volin | A45B 23/00 248/521 |
| 2015/0076313 | A1* | 3/2015 | Ma | E04H 12/2284 248/514 |
| 2020/0345114 | A1* | 11/2020 | Wang | A45B 25/00 |

FOREIGN PATENT DOCUMENTS

| | | | |
|---|---|---|---|
| CN | 109892768 | A | 6/2019 |
| CN | 209 473 820 | U | 10/2019 |
| DE | 10 2007 012 223 | A1 | 9/2008 |

* cited by examiner

LOCKING SYSTEM FOR THE ROTATING FOOT OF A MAST, PARTICULARLY FOR A FREE ARM STANDING PARASOL

CROSS-REFERENCE TO RELATED APPLICATION

This application claims priority to German patent application DE202020102422.1, filed Apr. 30, 2020, the entire disclosure of which is incorporated by reference herein.

TECHNICAL FIELD

The invention relates to a locking system for a rotating foot of a mast, particularly for a free arm standing parasol.

BACKGROUND

In numerous situations it is desirable to be able to rotate a free arm standing parasol around its mast axis when required, but otherwise to block such rotatability. Examples thereof are an adaptation of the orientation of the parasol according to the changing position of the sun, but also certain handling operations, for example turning away to allow passage of a vehicle or bulky object. In principle, several solutions have already been proposed for this objective, but they are all associated with certain disadvantages or limitations. However, there are always situations where a rotation of the mast is unnecessary or undesirable, such as, for example, in a street cafe with several parasols arranged in a row. Accordingly, a decision decides as to whether the parasol is needed with or without a rotating foot is already taken during the sales pitch.

U.S. Pat. No. 5,499,644 describes a rotatable free arm standing parasol in which two parts of a mast, which can be rotated against each other, are mutually latched with perforated disks and separate locking bolt. Such a solution lacks the convenience of an operating lever with a force reducing extension, and the open latching holes bear a risk of being clogged by dirt.

CN 109892768 A also relates to a rotatable free arm standing parasol. In this proposal, latching is proposed via a two-part mast with toothed coupling sleeves at an elevated operating height. A disadvantage is the small radius of the latching circle and the limitation of the number of latching positions. Wind stability of this type of mast is also problematic. A subsequent installation is very demanding. U.S. Pat. No. 8,807,513 B2 relates to a rotating foot for a free arm standing parasol. An exposed, U-shaped operating bracket acts via a mast-traversing axle through a pressure bar at the center of rotation of the mast onto the axially proximal, inner ends of two tilting levers, at the outer ends of which there are engaging pawls which engage between the teeth of a toothed ring under cooperation of pressure springs. The presence of a borehole through the mast means a weakening of the same, and the multi-component sequential arrangement of a lever, pressure bar, tilting lever, spring and toothed ring bears the risks of malfunction, such as, in particular, an uncontrolled jamming and an inadequate engaging. The exposed, short operating bracket requires the application of a large operating force in the case of large parasols and of winds coming up, and it furthermore tempts guests in a restaurant to change the rotational position of the mast in an uncontrolled manner.

CN 202955435 U relates to a rotating foot for a standing parasol and proposes a large locking radius for carrying out finely graduated rotational steps. The operating device consists of a latching bolt with spring support, which can be lifted out of the latching position by turning the operating handle along a circumferentially inclined support surface. No device is provided for bringing the operating handle to a comfortable operating height. Due to the facts that no ball-bearings are present and that only a short lever length is provided, an appreciable effort is required to turn the mast. Another disadvantage consists in the risk of stumbling due to the exposed, protruding handle close to the ground.

CN 205658488 U relates, inter alia, to a free arm standing parasol with a rotatable mast and a long, swiveling operating lever 418, which in its rest position is arranged parallel to the mast. Inside the mast, there is a raised counter bearing 414 resting on support 412, which is firmly connected to the mast profile by means of rivets 416. A disadvantage of this arrangement is the protruding end of the operating bar, into which clothes can get caught on passing by and which offers itself to uncontrolled manipulation by unauthorized persons. A trading concept according to which the parasol can be equipped with a rotating foot as an optional feature is complicated by the required machining of the mast.

SUMMARY OF THE INVENTION

An object of the invention is thus to propose an improved locking system for the rotating foot of a mast, in particular of a mast for a free arm standing parasol, which is capable of overcoming the disadvantage of the prior art.

In the locking system for the rotating foot of a mast, particularly of a mast for a free arm standing parasol according to the present invention, the mast is rotatable about an axis of rotation A defined by the rotating foot. The mast comprises a surrounded mast region. The locking system comprises an operating lever for releasing or locking of the rotating foot, which locking system is arranged on the mast at a comfort height (H) of 0.5 to 1.5 m above base level. The operating lever is movable between a folded-out position and a downwardly folded-in position and thereby cooperates via a lifting bar with stationary engaging elements of the rotating foot. The lifting bar is raised in its release position and lowered in its locking position.

The fact that the lifting bar is arranged at a distance from the axis of rotation and externally of the surrounded mast region, results inter alia in the following advantages:

- an operating lever that can be discreetly folded into the mast groove when not in use
- a clear control of the engaging and rotational position
- a high functional reliability and precisely selectable rotation positions due to a single-piece configuration of the lifting bar and locking catch and due to a flexible connection with the operating lever, which can also be folded in before mechanical engagement
- embodiments with small rotary adjustment steps of, for example, 15° are possible
- clean appearance of the mast without open passages in the mast profile
- no parts protruding from the mast in the resting position
- easy installation as an option when ordering from the dealer, but also subsequently at customer's site
- can be mounted on different anchoring variants.

In the present context, the terms "rotatable" and "stationary" are used, whereby "stationary" refers to any components which in principle remain in a fixed rotational relationship with respect to the surroundings, particularly with respect to the ground. In contrast, "rotatable" refers to any components which can perform a rotational movement about the axis of rotation A defined by the rotating foot when required, i.e., when the rotating foot is released. The terms "downwards" and "lowered" refer to a situation where the locking system is mounted on a ready-to-use rotating foot, so these terms shall be understood as synonymous with "downwards" or "pointing in a direction towards the ground".

The term "comfort height" shall be understood in relation to the handling of the locking system by an operating person. On the one hand, the engagement point, which represents a lowest point when the operating lever is folded-in, should be at least 0.5 m above the ground level of the rotating foot. On the other hand, the folded-out operating lever should be at most 1.5 m above the ground level. Accordingly, the operating lever in the folded-in position shall be located, considering its entire length, in a height range of 0.5 to 1.5 m from the ground level.

In principle the locking system according to the present invention can be used for rotating feet of a wide variety of mast-supported devices.

In an ergonomically and aesthetically advantageous embodiment the operating lever in its folded-in position is received in a lateral mast groove. In particular, this avoids undesirable protruding parts of the operating lever.

According to a particularly advantageous embodiment the operating lever and the lifting bar are coupled via a connecting hinge, which is provided with a tolerance bar by means of which, when the operating lever is folded-in, the lifting bar remains displaceable between a partially lowered position and a fully lowered position, wherein spring means are present to urge the lifting bar into the fully lowered position. The term "tolerance bar" is generally to be understood as a length compensation element, which can be realized in particular as a bar with a longitudinal slot. These measures allow the operating lever to be folded into the mast groove even if the current rotational position does not yet allow lowering into an engaging element of the rotating foot. Thereby, the spring means ensure that the desired locking takes place during a subsequent rotational movement of the mast.

It is advantageous if the spring means comprise a pressure spring, which is arranged between a guiding bracket for the lifting bar and a support part of the lifting bar located below the guiding bracket. The support part is attached to the lifting bar.

In principle, it shall be ensured that the lifting bar is guided in such manner that an undesirable canting is avoided.

According to an embodiment, which is particularly advantageous for an easy mounting of the locking system at the mast, guiding brackets for the lifting bar are provided, which can be inserted in a force-fitting manner into the mast groove by means of clamping screws. It shall be understood that the outer dimensions of such guiding brackets are to be selected in accordance with the inner dimension of the mast groove.

In a preferred embodiment the lifting bar is configured at the lower end thereof as a locking catch which is displaced from the axis of rotation A by a pivoting radius and which can be lowered into a correspondingly shaped stationary engaging element that is located below it. It is particularly advantageous, if the locking catch of the lifting bar is cranked outwards to increase the pivoting radius. This makes it possible to maintain a sufficient distance between adjacent engaging elements, or, for a given size of the individual engaging elements, to provide a comparatively smaller angular separation distance and thus a finer adjustment of the mast rotation.

It is also particularly advantageous if the rotating foot comprises stationary and rotatable plates stacked on top of each other, wherein one of the rotatable cover plates is rigidly connected directly or indirectly to the mast and comprises a guiding passage for the locking catch.

According to one embodiment the rotatable cover plate is mounted on a stationary latching plate, the cover plate being tightly connected to a counter plate, which is also rotatable and which absorbs tensile and compressive loads stemming from the mast, the stationary latching plate being provided with a plurality of engaging elements, which are circularly arranged about the axis of rotation A at predetermined angular intervals.

It is also advantageous, if the stationary latching plate is embraced by the rotatable cover plate and the rotatable counter plate.

Moreover, it is advantageous, if the stationary latching plate is directly or indirectly connected to a base plate serving as a support.

The base plate is either configured as a foot intended for ground contact, or it is configured with anchoring elements for mounting on a corresponding connecting part of a building, floor or the like.

In order to ensure rotatability in the smoothest, canting-free and permanent manner, it is advantageous to have appropriately dimensioned ball-bearings arranged between rotatable and stationary plates. In particular, these can be configured as annular bearing rings.

According to a further embodiment, the rotating foot comprises a bell cover for protecting movable parts located underneath. This is intended, in particular, to prevent excessive pollution and wetting of the bearings, but also to prevent clogging of the engaging elements.

A completely free rotatability, which would allow the execution of several full revolutions, is usually undesirable, for example in the presence of traversing power cables. An overwind protection can be implemented in various manners, whereby generally a corresponding blocking effect between a rotatable and a stationary component of the rotating foot is set up. According to an advantageous embodiment, the stationary base plate comprises a stop for a counter projection in the rotatable counter plate as an overwind prevention.

The aforementioned elements as well as those claimed and described in the following exemplary embodiments, to be used according to the invention, are not subject to any particular conditions by way of exclusion in terms of their size, shape, use of material and technical design, with the result that the selection criteria known in the respective field of application can be used without restrictions.

BRIEF DESCRIPTION OF THE DRAWINGS

Further details, advantages and features of the object of the present invention will become apparent from the following description and the corresponding drawings, in which the locking system according to the present invention is illustrated by way of example. In the drawings there are shown in.

DETAILED DESCRIPTION OF THE PREFERRED EMBODIMENTS

Figure 1:
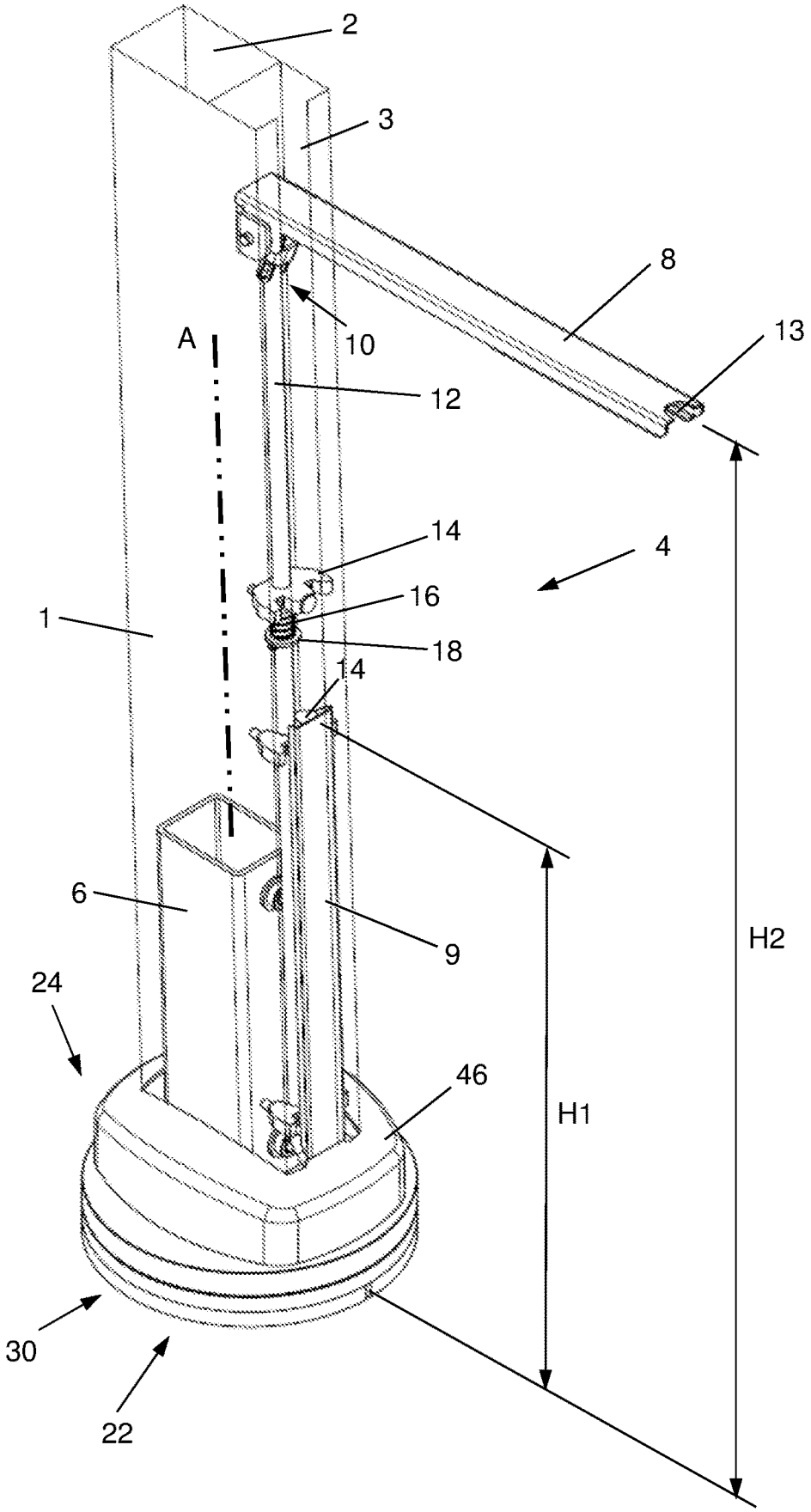
FIG. 1 a locking device on a rotating foot with a mast profile mounted thereon, with folded-out operating lever, in a perspective view.
Figure 2:
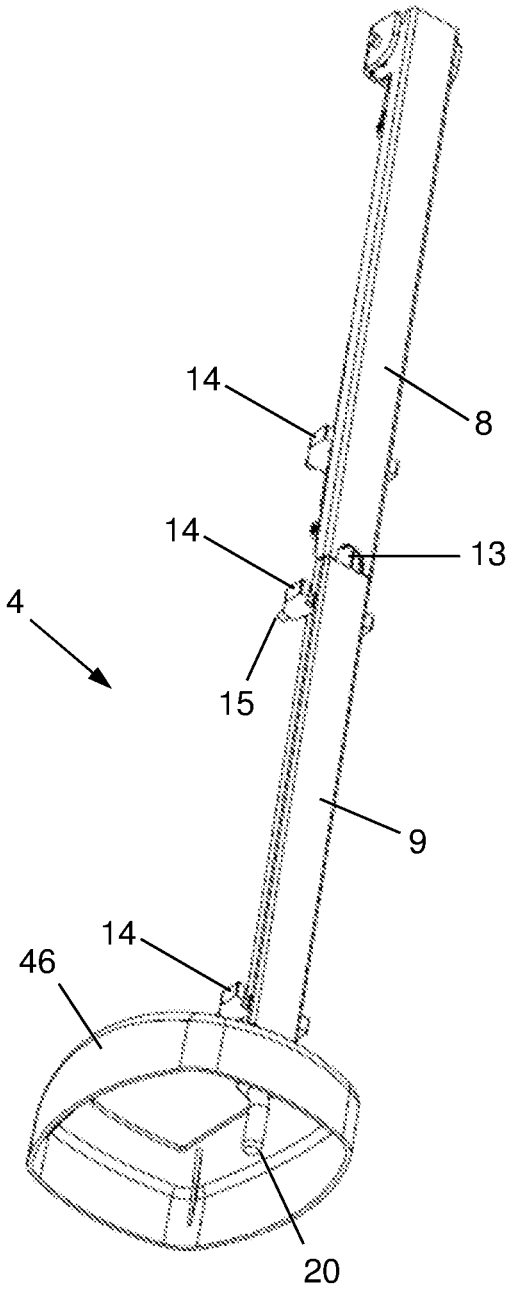
FIG. 2 the locking device of FIG. 1, with folded-out operating lever, in a perspective view.

FIGS. 1 and 2 show a locking system 4 for the rotating foot 22 of a mast 1, in particular for a mast for a free arm standing parasol. For example, such a rotating foot comprising a locking device according to the present invention is used for the mast profile of a free arm parasol in order to facilitate proper guidance of shadow under varying sun levels.

Figure 3:
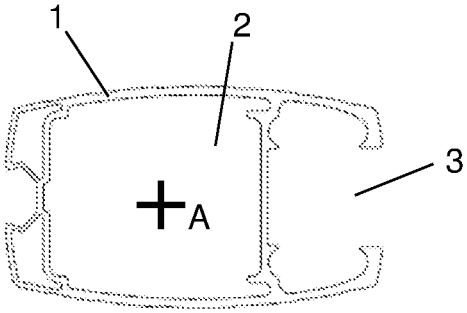
FIG. 3 a mast profile, in a cross-sectional view.

In FIG. 1, the mast 1 is shown in somewhat simplified form with a rectangular hollow profile and, in any case, it comprises a surrounded mast region 2 and a laterally adjoining region with an outer groove 3. The mast profile used in one exemplary embodiment is shown in FIG. 3.

The rotating foot 22 comprises, on the one hand, stationary parts 30 and, on the other hand, parts 24 that can be rotated about an axis of rotation A. As can be seen from FIG. 1, the mast 1 is mounted onto and fastened to an appropriately configured mounting tube 6 and thus can be rotated together with the mounting tube about the axis of rotation A.

The locking system 4 comprises an operating lever 8 for releasing or locking the rotating foot, the operating lever being arranged on the mast at a comfort height above the rotating foot 22. The operating lever 8 is movable between a folded-out release position as shown in FIG. 1 and a downwardly folded-in locking position. The latter is illustrated in FIG. 2. The operating lever 8 is connected via a connecting hinge 10 to the upper end of a lifting bar 12, the lower end of which cooperates with stationary engaging elements of the rotating foot 22. Such an engagement element 34 can be seen in FIG. 5.

In the release position shown in FIG. 1 with folded-out operating lever 8, the lifting bar 12 is elevated. In the locking position shown in in FIG. 2 with a downwardly folded-out operating lever 8, the lifting bar 12 is lowered, so that its lower end 20, which acts as a locking catch, is also lowered.

Advantageously, the downwardly folded-out operating lever 8 fits into the mast groove 3 and thus forms a continuation of the outer mast profile, which is further continued or completed by a cover strip 9 adjacently disposed below the operating lever 8. Accordingly, the operating lever 8 in its basic position fits in a practically seamless manner into the mast design. Appropriately, a terminal recess is provided at the operating lever 8 to facilitate gripping of the operating lever.

As can be seen in particular from FIG. 1, the lifting bar 12 is arranged at a distance from the axis of rotation A and can thus be mounted on the mast outside of the enclosed mast region 2. For this purpose, it is appropriate to use guiding brackets 14 with clamping screws 15, the guiding brackets being configured to match the mast profile in the region of the mast groove 3.

Figure 4:
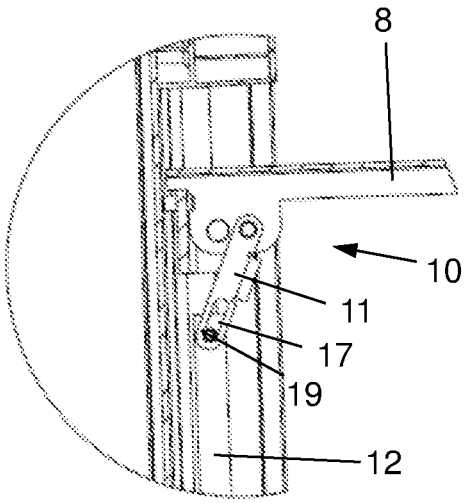
FIG. 4 a section of a mast with locking device, with folded-out operating lever, in an elevational view.

In the exemplary embodiment shown here, the operating lever 8 and the lifting bar 12 are coupled via a connecting hinge 10, which is provided with a tolerance bar 11. As can be seen from FIG. 4, the tolerance bar 11 is hingedly connected to the operating lever 8 or to the lifting bar 12. In the latter case, a compensation slot 17 formed in the tolerance bar allows longitudinal movement of the hinge bolt 19 of a lifting bar 12 retained therein. Therefore, when the operating lever is in its folded-in position, the lifting bar remains movable between a partially lowered and a fully lowered position. A pressure spring 16, shown in FIG. 1, arranged between guiding bracket 14 and a support part 18 of the lifting bar exerts a spring force to urge the lifting bar into the fully lowered position. As will henceforth be explained, the described measures allow the operating lever 8 to be folded into the mast groove 3 even if the current rotational position does not yet allow lowering into an engaging element of the rotating foot.

Figure 5:
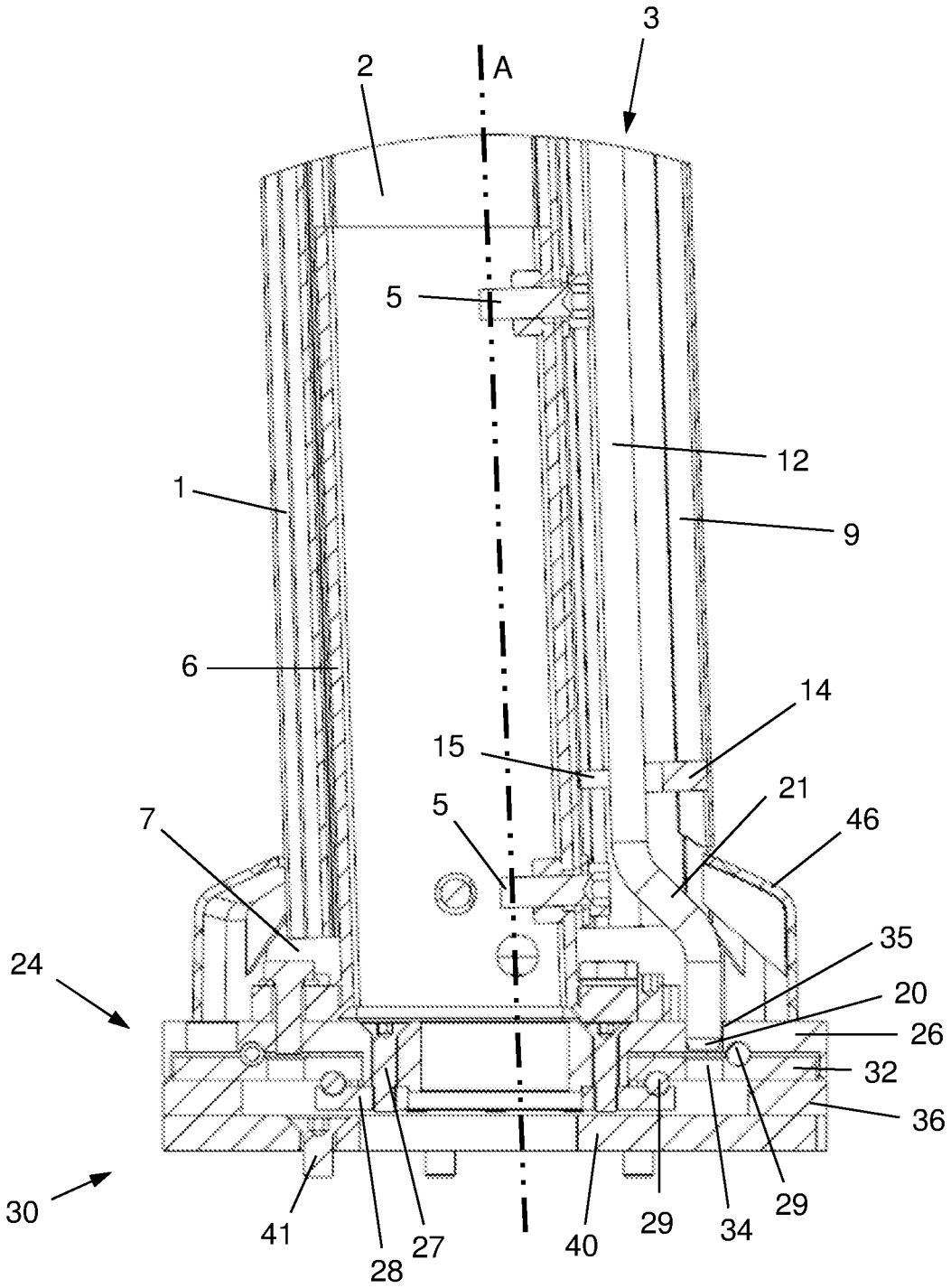
FIG. 5 a section of the mast with locking device and rotating foot, in released position, in a longitudinal sectional view.

FIG. 5 shows the structure of the rotating foot 22 with mounted mast profile 1 and parts of the locking device. The mast profile 1 stands on a mounting flange 7 and is attached to the mounting tube 6 by means of mounting bolts 5. The rotating foot is built up from stationary and rotatable plates stacked on top of each other and which move with respect to each other on ball-bearings 26. A rotatable cover plate 26 is rigidly connected to the mast profile 1. The cover plate 26 is provided with a guiding passage 35 for the locking catch 20, which provides the necessary access to an engaging element 34 located underneath. The latter is formed in a latching plate 32 arranged below the cover plate 26. As can be seen from FIG. 5, the stationary latching plate 32 is embraced by the rotatable cover plate 26 and by a rotatable counter plate 28 which is connected to the rotatable cover plate by means of connecting screws 27. As a consequence, the tensile and compressive loads stemming from the mast are absorbed.

The latching plate 32 rests in the edge region thereof on a distance ring 36, which in turn rests on the base plate 40 of the rotating foot. The base plate 40 is appropriately provided with connecting screws 41 for a ground anchoring. The distance ring 36 forms a space for the rotating counter plate 28.

In the embodiment shown, the lifting bar 12 comprises an offset 21 in the lower region to increase the pivoting radius. In this manner, the guiding passage 35 provides a lateral stabilization of the lifting bar 12 and prevents undesirable displacement or canting. Moreover, a bell cover 46 mounted on the rotating foot 22 protects for the movable parts located underneath.

To initiate a mast rotation, the operating lever 8 is folded out upwards, whereby the lifting bar 12 is raised via the operating lever hinge 10 and the tolerance bar 11. Thereby, the locking catch 20 is lifted out of the engaging point 34 of the latching plate 32, as shown in FIG. 5. The mast profile 1 can now be brought into the desired rotational position by means of the operating lever 8. Thereafter, the operating lever is folded back into the mast groove 3. As already mentioned in connection with FIG. 1, the lifting bar 12 is held by guiding brackets 14, which are clamped in a force-fitting manner into the mast groove by means of clamping screws 15. The pressure spring 16 arranged between the guiding bracket 14 and the support part 18 ensures that the locking catch 20 is latched with the rotating parts 24 and the anchoring parts 30.

Figure 6:
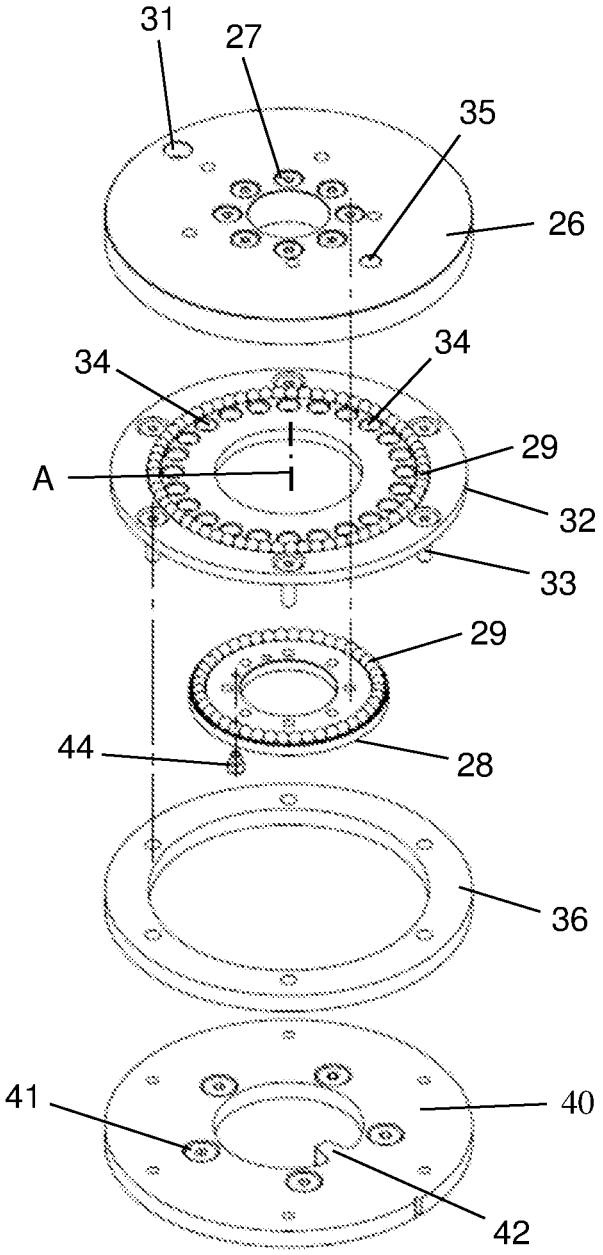
FIG. 6 the rotating foot, in an exploded view.

As can be seen, in particular from FIG. 6, the latching plate 32 is provided with a plurality of engaging elements 34, which are circularly arranged about the axis of rotation A at predetermined angular intervals. An access hole 31 in the cover plate 26 allows mounting of connecting screws 33 of the latching plate 32 with the spacer ring 36.

Moreover, in the example shown, the stationary base plate 40 comprises a stop 42 for a counter projection 44 in the rotatable counter plate 28 as an overwind prevention.

LIST OF REFERENCE NUMERALS

1 mast profile
2 surrounded mast region

3 mast groove
4 locking system
5 mounting bolt
6 mounting tube
7 mounting flange
8 operating lever
9 cover strip
10 operating lever hinge
11 tolerance bar
12 lifting bar
13 terminal recess of 8 (engagement point)
14 guiding bracket
15 clamping screw
16 pressure spring
17 compensation slot of 11
18 support part
19 hinge bolt of 11
20 locking catch
21 offset
22 rotating foot
24 rotating parts
26 cover plate
27 connecting screw for cover plate 26/counter plate 28
28 counter plate
29 ball-bearing
30 anchoring parts (stationary)
31 access hole to connecting screws 33
32 latching plate
33 connecting screw for latching plate 32/distance ring 36/base plate 40
34 engaging points for locking catch 20
35 guiding passage
36 distance ring
40 base plate
41 connecting screw for base plate/ground anchoring
42 overwind prevention pawls
44 overwind counterscrew
46 bell cover

The invention claimed is:

1. A locking system for a rotating foot of a mast, particularly of a mast for a free arm standing parasol, wherein the mast is rotatable about an axis of rotation (A) defined by the rotating foot and comprises a surrounded mast region, and wherein the locking system comprises an operating lever for releasing or locking of the rotating foot which is arranged on the mast at a comfort height (H) of 0.5 to 1.5 m above the rotating foot, wherein the operating lever is movable between a folded-out position and a downwardly folded-in position and thereby cooperates via a lifting bar with stationary engaging elements of the rotating foot, wherein the lifting bar is raised in the release position and lowered in the locking position, characterized in that, the lifting bar is arranged at a distance from the axis of rotation and externally of the surrounded mast region, and the operating lever in its folded-in position is received in a lateral mast groove.

2. The locking system according to claim 1, characterized in that the operating lever and the lifting bar are coupled via a connecting hinge, which is provided with a tolerance bar by means of which, when the operating lever is folded-in, the lifting bar remains displaceable between a partially lowered position and a fully lowered position, wherein spring means are present to urge the lifting bar into the fully lowered position.

3. The locking system according to claim 2, characterized in that the spring means comprise a pressure spring, which is arranged between a guiding bracket for the lifting bar and a support part of the lifting bar located below the guiding bracket.

4. The locking system according to claim 3, characterized in that it comprises guiding brackets for the lifting bar, which can be inserted in a force-fitting manner into the mast groove by means of clamping screws.

5. The locking system according to claim 3, characterized in that the lifting bar is configured at the lower end thereof as a locking catch, which is displaced from the axis of rotation (A) by a pivoting radius and which can be lowered into a correspondingly shaped stationary engaging element which is located below it.

6. The locking system according to claim 2, characterized in that it comprises guiding brackets for the lifting bar, which can be inserted in a force-fitting manner into the mast groove by means of clamping screws.

7. The locking system according to claim 2, characterized in that the lifting bar is configured at the lower end thereof as a locking catch, which is displaced from the axis of rotation (A) by a pivoting radius and which can be lowered into a correspondingly shaped stationary engaging element which is located below it.

8. The locking system according to claim 1, characterized in that it comprises guiding brackets for the lifting bar, which can be inserted in a force-fitting manner into the mast groove by means of clamping screws.

9. The locking system according to claim 8, characterized in that the lifting bar is configured at the lower end thereof as a locking catch, which is displaced from the axis of rotation (A) by a pivoting radius and which can be lowered into a correspondingly shaped stationary engaging element which is located below it.

10. The locking system according to claim 1, characterized in that the lifting bar is configured at the lower end thereof as a locking catch, which is displaced from the axis of rotation (A) by a pivoting radius and which can be lowered into a correspondingly shaped stationary engaging element which is located below it.

11. A locking system for a rotating foot of a mast, particularly of a mast for a free arm standing parasol, wherein the mast is rotatable about an axis of rotation (A) defined by the rotating foot and comprises a surrounded mast region, and wherein the locking system comprises an operating lever for releasing or locking of the rotating foot which is arranged on the mast at a comfort height (H) of 0.5 to 1.5 m above the rotating foot, wherein the operating lever is movable between a folded-out position and a downwardly folded-in position and thereby cooperates via a lifting bar with stationary engaging elements of the rotating foot, wherein the lifting bar is raised in the release position and lowered in the locking position, characterized in that, the lifting bar is arranged at a distance from the axis of rotation and externally of the surrounded mast region, the rotating foot comprises stationary and rotatable plates stacked on top of each other, wherein one of the rotatable cover plates is rigidly connected directly or indirectly to the mast and comprises a guiding passage for the locking catch, the rotatable cover plate is mounted on a stationary latching plate, the cover plate being tightly connected to a counter plate and absorbing tensile and compressive loads stemming from the mast, the stationary latching plate being provided with a plurality of engaging elements, which are circularly arranged about the axis of rotation (A) at predetermined angular intervals, the stationary latching plate is directly or indirectly connected to a base plate serving as a support, and the stationary base plate comprises a stop for a counter projection in the rotatable counter plate as an overwind prevention.

* * * * *